US011339037B2

(12) United States Patent
Reid

(10) Patent No.: US 11,339,037 B2
(45) Date of Patent: May 24, 2022

(54) WINCH MOUNTED TO PORTABLE HOIST

(71) Applicant: Nicholas Reid, Colstrip, MT (US)

(72) Inventor: Nicholas Reid, Colstrip, MT (US)

( * ) Notice: Subject to any disclaimer, the term of this patent is extended or adjusted under 35 U.S.C. 154(b) by 0 days.

(21) Appl. No.: 16/894,722

(22) Filed: Jun. 5, 2020

(65) Prior Publication Data

US 2020/0385248 A1 Dec. 10, 2020

Related U.S. Application Data

(60) Provisional application No. 62/857,416, filed on Jun. 5, 2019.

(51) Int. Cl.

| | |
|---|---|
| ***B66D 1/12*** | (2006.01) |
| ***B66D 3/18*** | (2006.01) |
| ***B66D 1/36*** | (2006.01) |
| ***B66D 1/56*** | (2006.01) |
| ***B66D 3/26*** | (2006.01) |
| *B66D 1/42* | (2006.01) |

(52) U.S. Cl.

CPC ..... *B66D 1/12* (2013.01); *B66D 1/36* (2013.01); *B66D 1/56* (2013.01); *B66D 3/18* (2013.01); *B66D 3/26* (2013.01); *B66D 1/42* (2013.01); *B66D 2700/0166* (2013.01); *B66D 2700/0191* (2013.01); *B66D 2700/025* (2013.01)

(58) Field of Classification Search

CPC ... B66D 1/12; B66D 1/36; B66D 1/56; B66D 1/42; B66D 3/26; B66D 3/18; B66D 2700/0166; B66D 2700/0191; B66C 13/08; B66C 13/085; B66C 1/34; B66C 23/20; B66C 23/201; B66C 23/203; B66C 23/205

See application file for complete search history.

(56) References Cited

U.S. PATENT DOCUMENTS

| | | | |
|---|---|---|---|
| 1,350,297 | A | 8/1920 | Cooley |
| 1,938,071 | A | 12/1933 | Hummel |
| 2,335,571 | A | 1/1941 | Schroeder |
| 2,244,221 | A | 6/1941 | Schroeder |
| 2,435,328 | A | 12/1945 | Smith |
| 2,570,833 | A | 3/1947 | Metcalf |
| 2,991,976 | A | 7/1961 | Carroll |
| 3,741,527 | A | 6/1973 | Dahl |
| 4,221,364 | A | 9/1980 | Nishimura |
| 4,432,306 | A | 2/1984 | Rossa |
| 6,062,543 | A | 5/2000 | Kobayasi |
| 6,085,368 | A | 7/2000 | Robert |
| 6,209,852 | B1 | 4/2001 | George |
| 6,241,215 | B1 | 6/2001 | Gersemsky |
| 6,554,255 | B2 | 4/2003 | Fujikawa |
| 7,350,247 | B2 | 4/2008 | Bogh-Sorensen |
| 7,380,770 | B2 | 6/2008 | Tzeng |
| 9,421,140 | B2 | 8/2016 | Faucher |
| 2012/0018689 | A1 | 1/2012 | Chepurny |

*Primary Examiner* — Michael E Gallion

(74) *Attorney, Agent, or Firm* — Scott Swanson

(57) ABSTRACT

A portable hoist and a winch. The winch and hoist can be integrated in a single housing or can be attached to one another. The portable hoist provides a user with the ability to hang the portable hoist without the use of other lifting devices, cranes, or rigging and allows the user to do it in a safer manner with less man power. The portable hoist can have a safety pin configured to secure the winch hook in a secured position so as to allow the hoist to lift increased loads.

14 Claims, 9 Drawing Sheets

WINCH MOUNTED TO PORTABLE HOIST

PRIORITY/CROSS-REFERENCE TO RELATED APPLICATIONS

This application claims the benefit of U.S. Provisional Application No. 62/857,416, filed Jun. 5, 2019, the disclosure of which is incorporated by reference.

BACKGROUND

Technical Field

The presently disclosed technology relates generally to hoists, and more specifically a portable hoist with a winch.

Background

Hoists are devices regularly used for lifting or lowering a load. Hoists may be manually operated, electrically or pneumatically driven and may use chain, fiber or wire rope as its lifting cable. Hoists are generally heavy-duty, and while some are small and movable, attaching them to their elevated attachment point usually requires lifting devices, cranes, or rigging.

Winches are devices used to wind a cable or a rope in or out, so that the resulting tension pulls an object. Winch drums are typically powered by air, electricity, or hydraulics and are designed for a specific load capacity. Winches are generally lighter than hoists. However, winches are not ideal in lifting objects as heavy as hoists because the typical winch braking design utilizes gears in the winch for resistance making it generally unstable for suspended loads.

What is needed is a hoist that is portable that uses an integrated winch in pulling the hoist to its elevated attachment point and securely locks the hoist in place.

SUMMARY OF THE INVENTION

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) of the application, which is measured by the claims, nor is it intended to be limiting as to the scope of the inventive concept(s) in any way.

What is disclosed is a portable hoist with a winch. This provides a user with the ability to hang the portable hoist without the use of other lifting devices, cranes, or rigging and allows the user to do it in a safer manner with less man power. The hoist can be either pneumatic or electric or other variations of hoists known in the art, including being manually operated. In a preferred embodiment, the hoist has a drum, a hoist cable, and a hoist housing. The hoist cable can be a chain, metal cable, rope, fiber cable, or any other cable construction known in the art. The hoist can be any variation of capacity.

In a preferred embodiment, the winch attaches to the exterior of the hoist housing. In alternate embodiments, the winch is integrated with the hoist. The winch preferably includes a motor, a winch cable, and a winch hook. The winch cable can include a rope, a metal cable, a fiber cable, a chain, or any other cable used in winch construction. The winch motor is preferably a lower capacity than the hoist. In alternate embodiments the winch motor can be any variation of capacity.

The winch is configured to attach to a hoisting point. The winch is configured to pull the portable hoist towards a hoisting point. The hoisting point is any elevated position that a user would typically attach a hoist. In alternate embodiments, the winch may be positioned within the hoist housing such that it does not interfere with the hoist. In alternate embodiments the hoist includes winch cable configured to attach to the elevated attachment point.

In one embodiment, a metal cable guide with a first side and a second side is attached to the exterior of the winch housing. The first side and the second side of the cable guide define a cable passageway. A pulley is preferably positioned between the first and second side of the cable guide. The pulley is configured to direct the winch line and to reduce the tension on the winch. In this embodiment, the distal ends of the first and second side define pin openings. The pin openings are configured for a safety pin to be inserted through and secure the winch hook into position. The safety pin includes, but is not limited to, hitch pins, clevis pins, cotter pin, or other pin commonly used in the art.

In an alternate embodiment, a safety pin is configured to secure the winch cable into a fixed position to secure the positioning of the hoist. In a further embodiment, the winch is configured to secure the portable hoist in position by a latch, clamp, or other construction known in the art to restrict cable movement.

In one embodiment, the portable hoist includes a limit switch. The limit switch is configured to transfer power from the winch to the hoist allowing for the hoist to hoist objects. In this embodiment, the limit switch is preferably activated by the insertion of the safety pin. In alternate embodiments the limit switch may be manually activated.

Still other features and advantages of the claimed invention will become readily apparent to those skilled in this art from the following detailed description describing preferred embodiments of the invention, simply by way of illustration of the preferred embodiments contemplated by carrying out my invention. As will be realized, the invention is capable of modification in various obvious respects all without departing from the invention. Accordingly, the description of the preferred embodiments are to be regarded as illustrative in nature, and not as restrictive in nature.

DETAILED DESCRIPTION OF THE EMBODIMENTS

Figure 1:
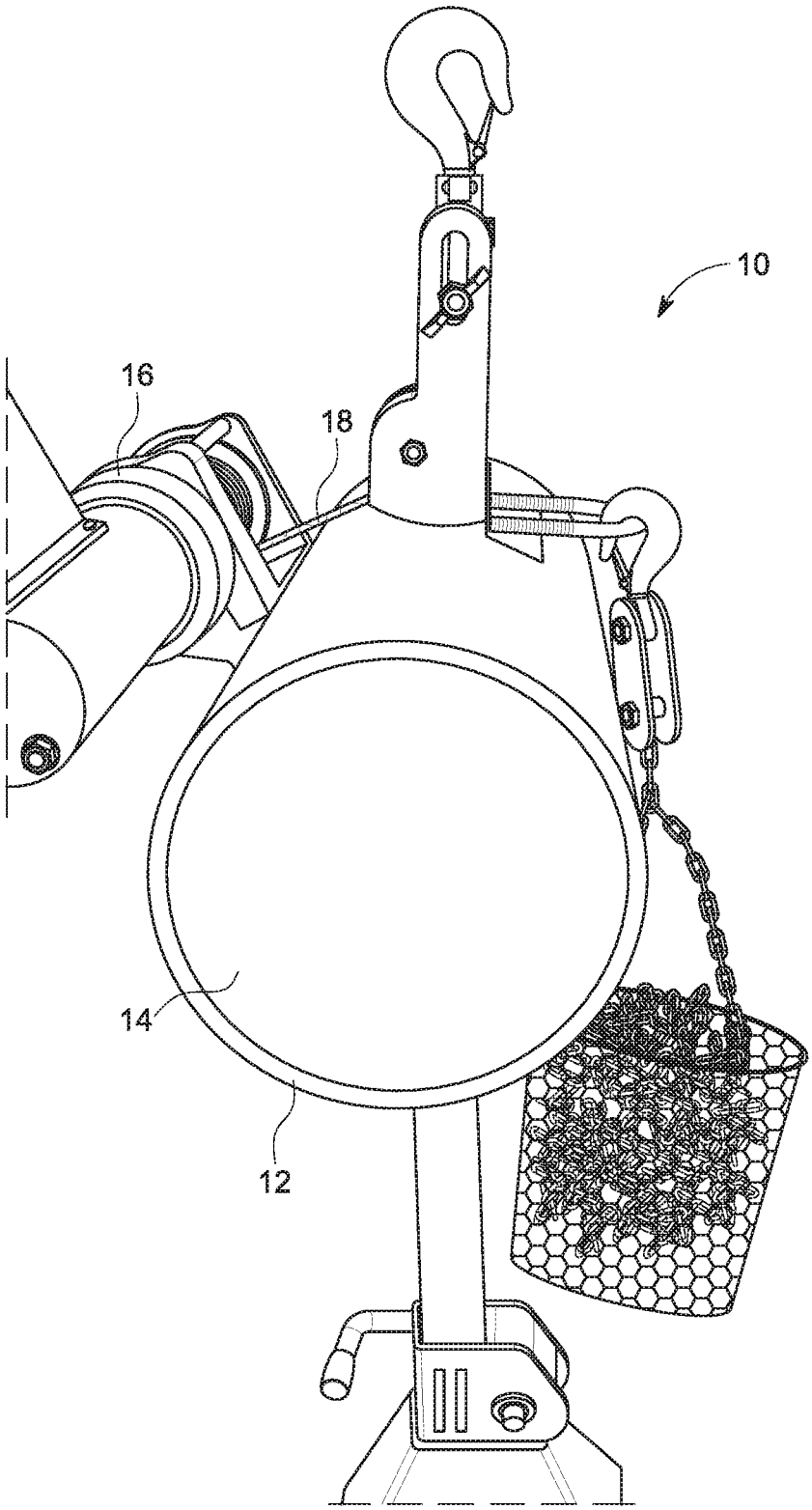
FIG. 1 is a side view of an embodiment of a portable hoist and winch.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

FIG. 1 depicts an embodiment of the portable hoist 10. The portable hoist 10 has a hoist housing 12 that houses the hoist 14. The hoist can be either pneumatic or electric or other variations of hoists known in the art, can utilize chain or wire rope, and can be any variation of capacity.

In a preferred embodiment, the exterior of the housing 12 attaches a motorized winch 16. The winch 16 preferably utilizes a cable 18 which can be a steel cable, synthetic cable, or other cable commonly used in winch construction. The winch 16 requires sufficient power to have enough line pull to lift the portable hoist 10 above the ground to a hoisting point. The hoist 14 and winch 16 can be operated by one control remote 17 or have a separate winch control remote and hoist control remote (illustrated in FIG. 3).

In a preferred embodiment, a cable guide 29 attaches to the exterior of the housing 12. The cable guide 29 is configured to guide the cable 18 and the winch hook 27. The cable guide 29 defines pin openings 32 configured for the insertion of a safety pin 34. The safety pin 34 secures the portable hoist 10 in its desired position.

Figure 2:
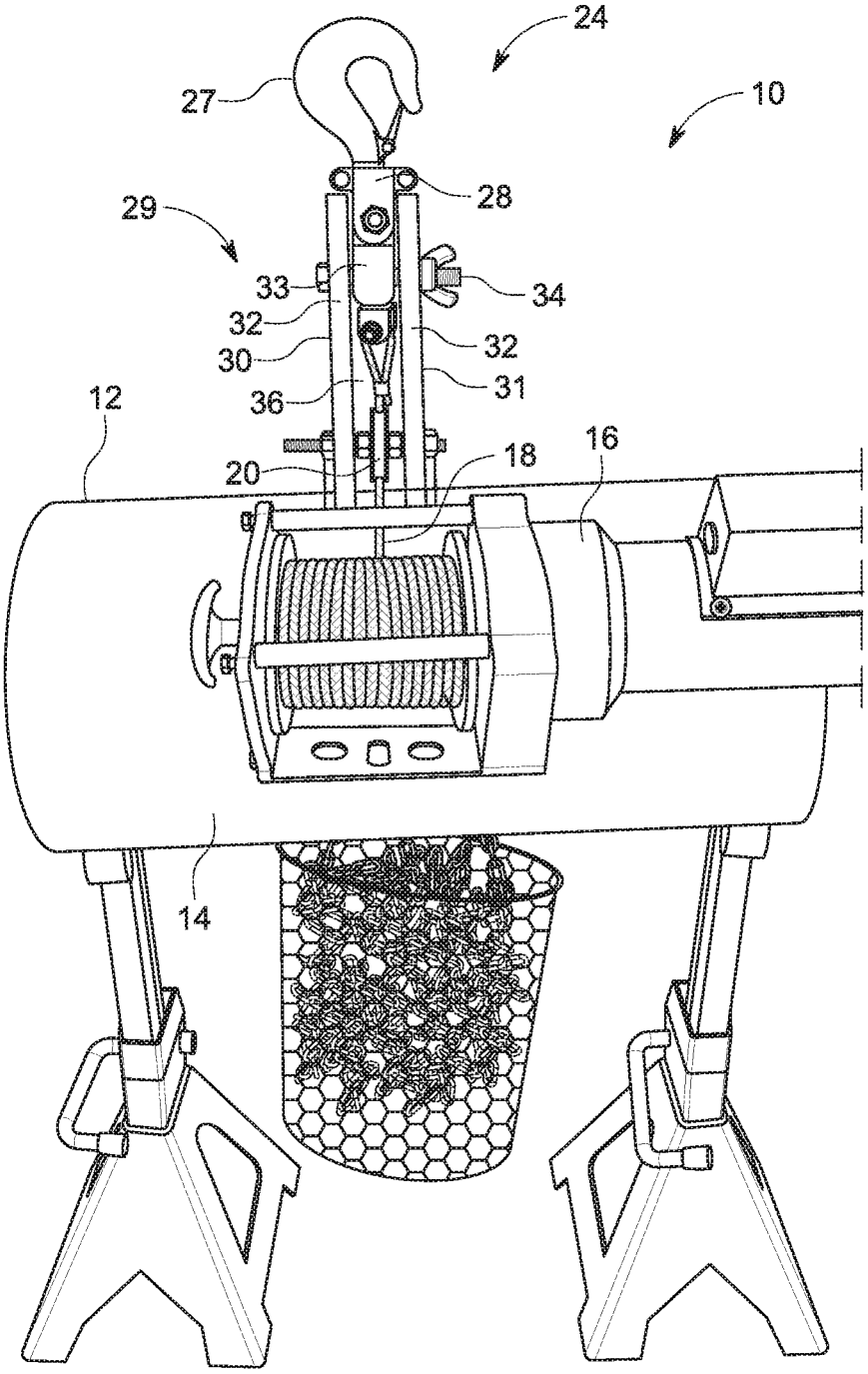
FIG. 2 is a front view of the portable hoist and winch shown in FIG. 1.
Figure 5:
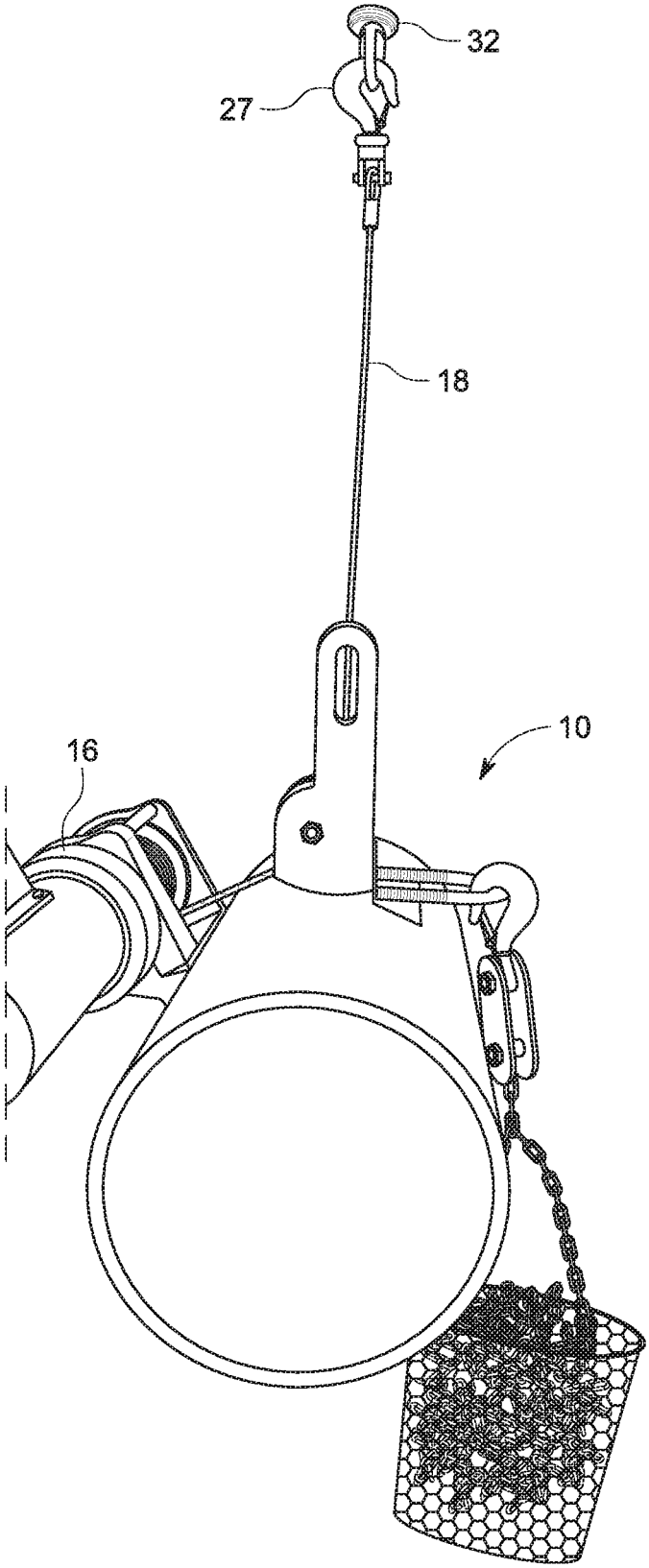
FIG. 5 is a side view of the portable hoist and winch in FIG. 1 attaching to a hoisting point.
Figure 6:
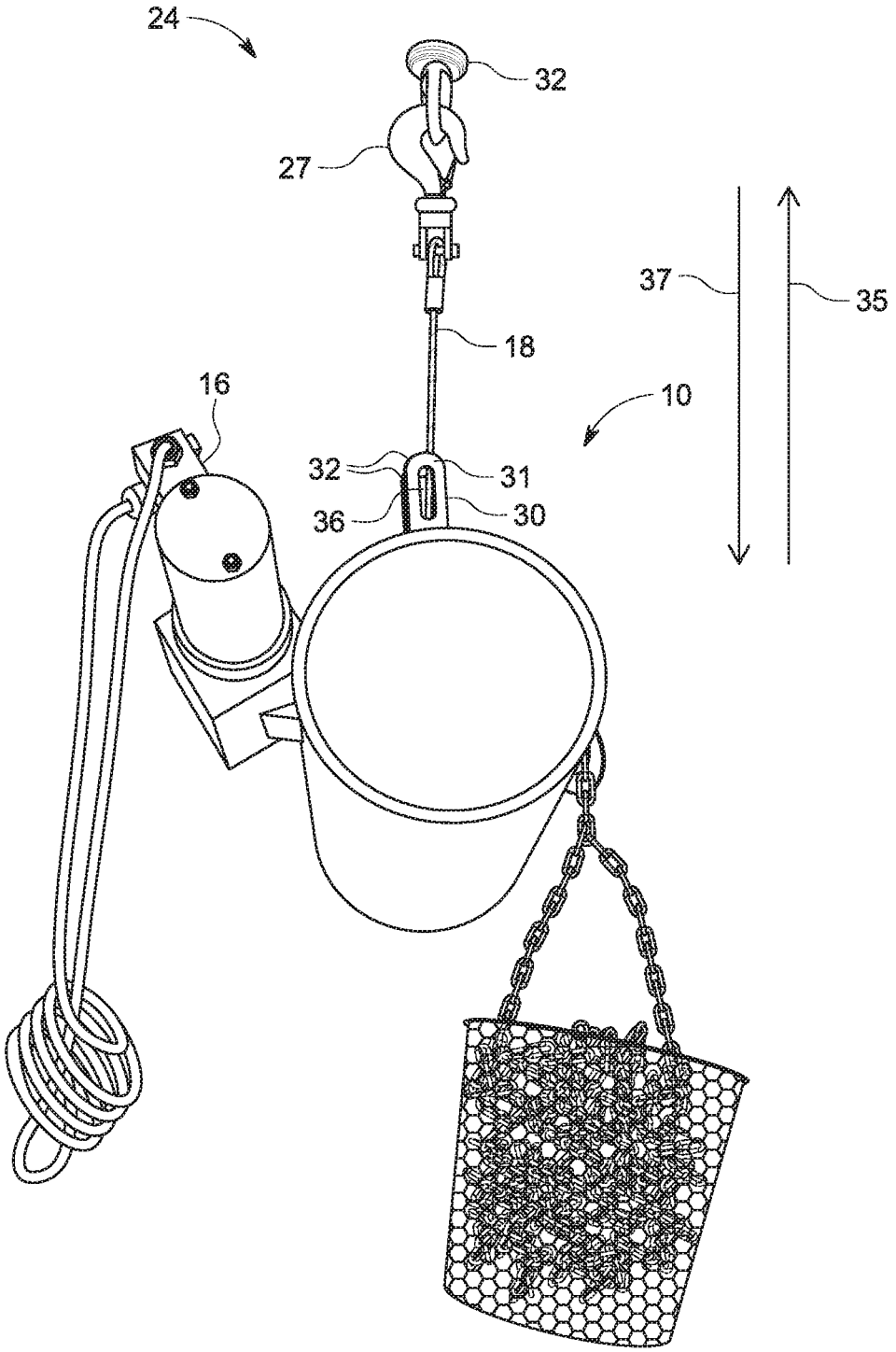
FIG. 6 is a side view of the portable hoist and winch in FIG. 1 raising to a hoisting point.

FIG. 2 illustrates a preferred embodiment of the winch 16 having a winch hook assembly 24 attached to the end of the cable 18. In a preferred embodiment, the winch hook assembly 24 has a winch hook 26, a bearing 28 that allows the winch hook 26 to rotate freely, and a winch shackle 30. The winch shackle 30 attaches the bearing 28 to the cable 18. The winch hook 27 is configured to attach to elevated attachment points (illustrated in FIGS. 3 and 5). The attachment points can be mobile (such as being positioned on a track) or fixed, and can be any structure or design that fits the insertion of a hook. The winch hook assembly 24 is secured into position by the safety pin 34.

The cable guide 29 preferably has a first side 30 and a second side 31. The pin openings 32 are preferably positioned on the distal ends of the sides 30, 31. The sides 30, 31 preferably define a passageway 36 or channel allowing for the winch cable 18 to pass. In alternate embodiments, the cable guide can be a tubular projection or any other projection configured to provide a channel for the winch line and secure the hook assembly or winch hook into a locked position.

In a preferred embodiment the cable 18 passes through a pulley 20 to reduce the force exerted on the winch 16 and to center the weight of the portable hoist 10. The pulley 20 is preferably positioned between the first and second sides 30, 31 of the cable guide 29.

Figure 3:
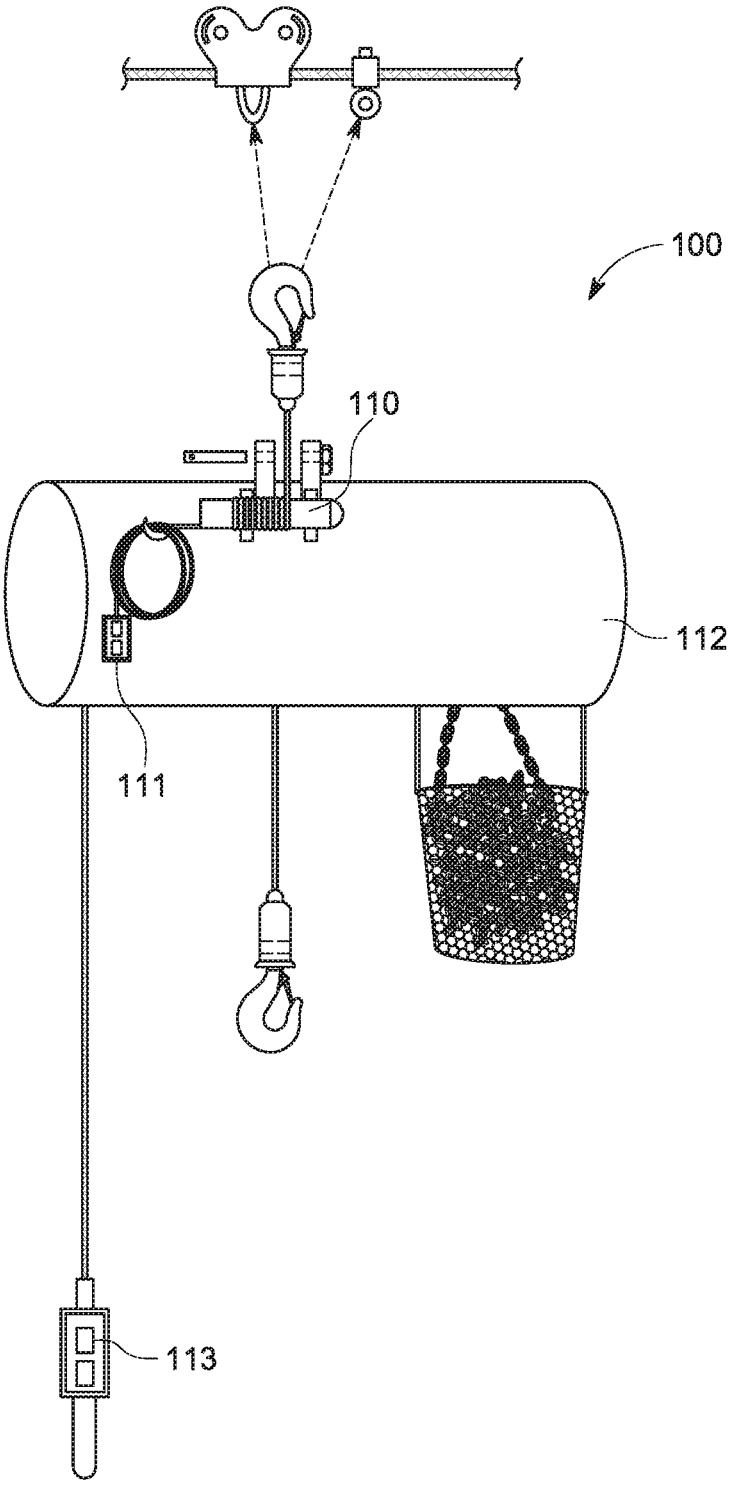
FIG. 3 is a front exploded view of the portable hoist and winch in FIG. 1 with hoisting points.
Figure 4:
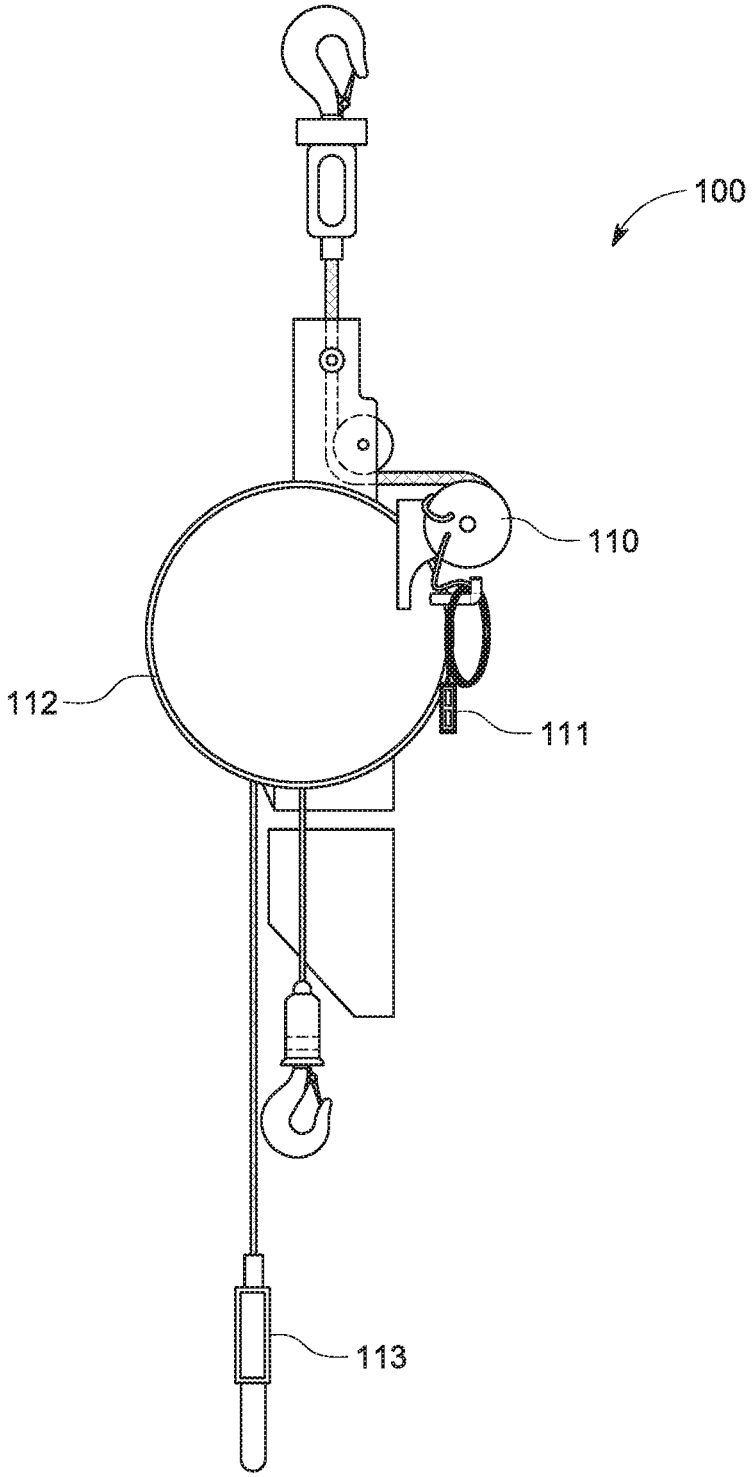
FIG. 4 is a side cross sectional view of the metal cable guide of the portable hoist and winch in FIG. 1.

FIGS. 3 and 4 illustrates an alternate embodiment of the portable hoist 100. In this embodiment, the winch 110 is operated by a winch control remote 111 and the hoist 112 is operated by a hoist control remote 113. In further embodiments, the winch and/or hoist can be operated by a wireless transmitter, such as Bluetooth or any other wireless connection.

FIGS. 5, 6, 7, and 8 illustrate the winch hook 27 attaching to a fixed attachment point 32. Illustrated in FIG. 5, the winch 16 releases the cable 18 allowing the winch hook 27 to extend to a desired attachment point 32. A user then activates the winch 16, pulling the portable hoist 10 in a direction 34 towards the attachment point 32 (illustrated in FIG. 7).

Figure 7:
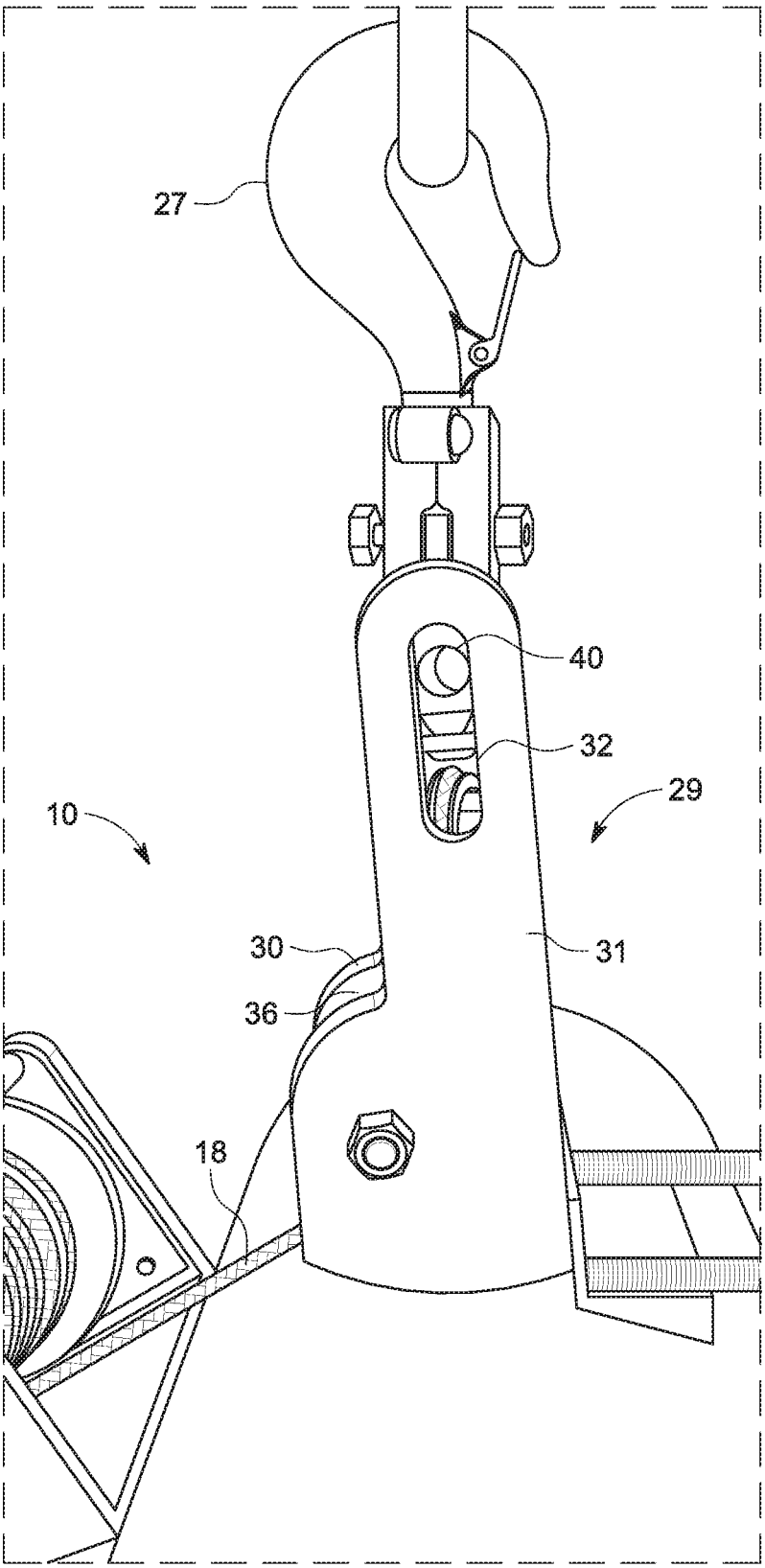
FIG. 7 is a side sectional view of the metal cable guide and winch hook assembly of an embodiment of a portable hoist and winch attached to a hoisting point.

FIG. 7 illustrates the portable hoist 10 in position to hoist an object. The winch assembly 24 is configure to fit within the cable guide sides 30, 31 in the channel 36 and has a winch pin opening 40 configured to align with pin openings 32. Once cable 18 is appropriately wound up, the pin opening 40 of the winch assembly 26 is configured to align with the pin openings 32 of the cable guide 29. The winch 16 preferably does not wind up the cable 18 further than the alignment point between the pin openings 23, 32.

Figure 8:
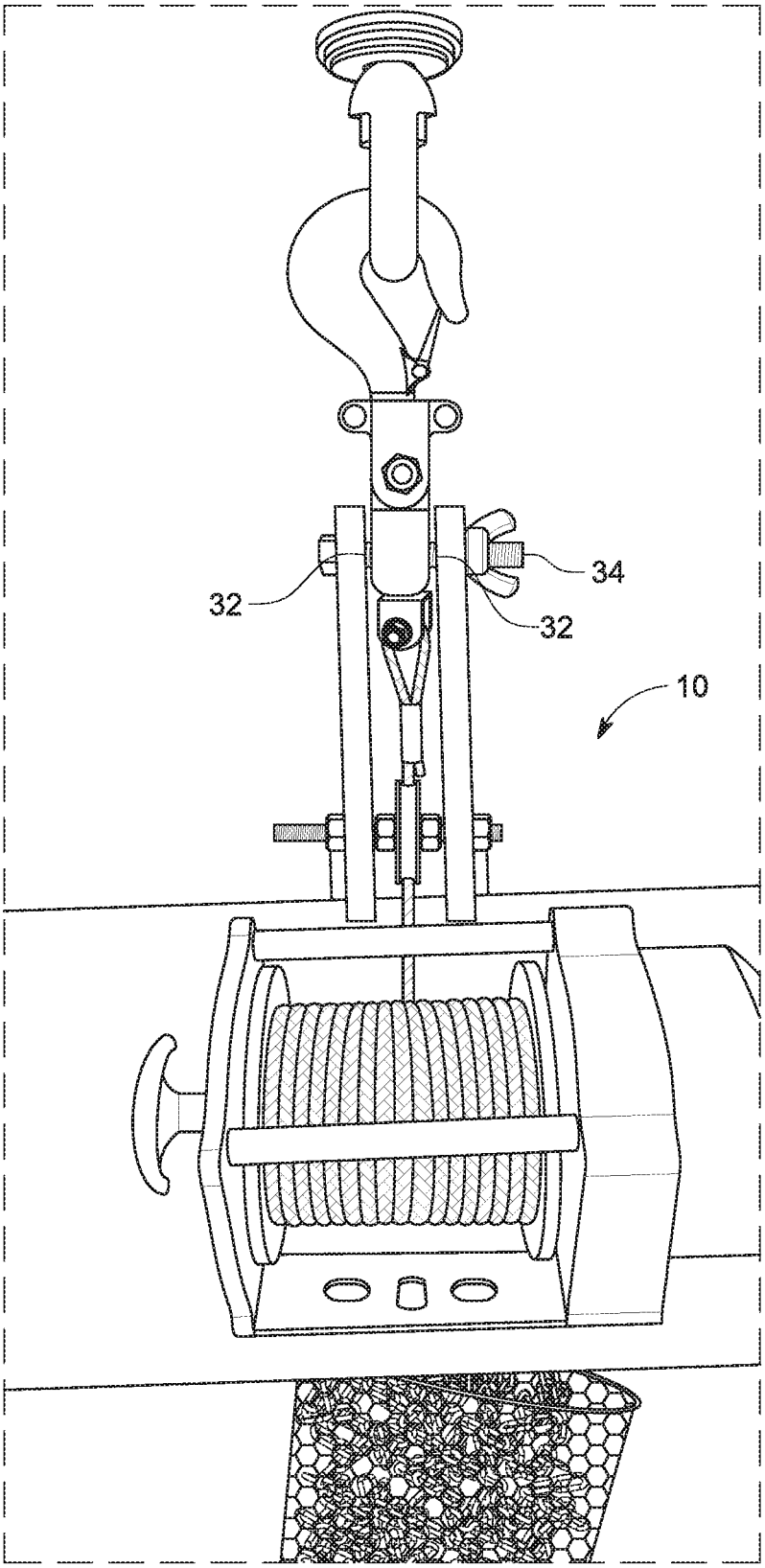
FIG. 8 is a front sectional view of an embodiment of a portable hoist and winch secured in position by a safety pin.

FIG. 8 illustrates a safety pin 34, such as a clevis pin or hitch pin, is inserted through the pin openings 32 to safely secure the portable hoist 10 in position over the object to be hoisted.

Figure 9:
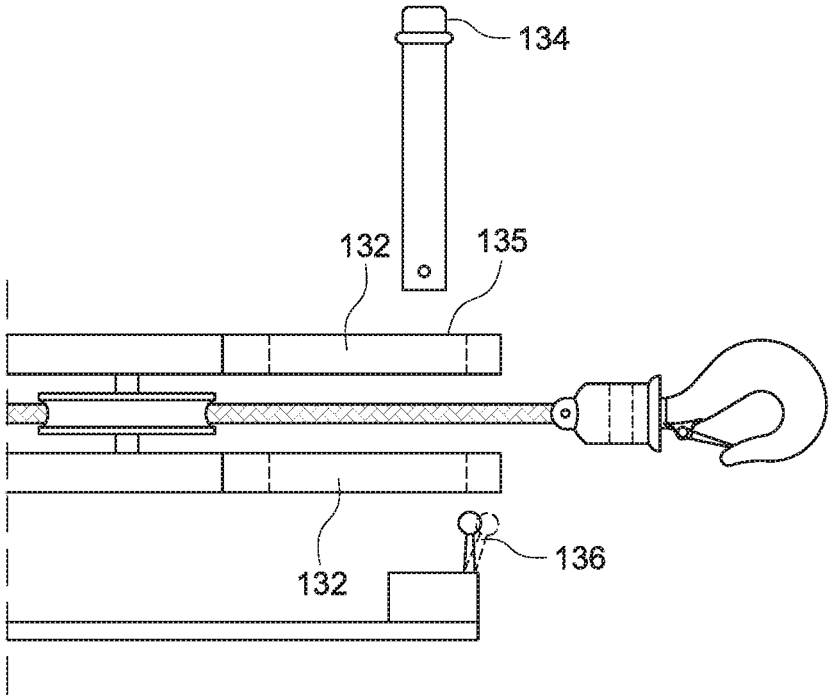
FIG. 9 is a sectional view of an embodiment of the potable hoist and winch guide arm with a safety pin exploded out.
Figure 10:
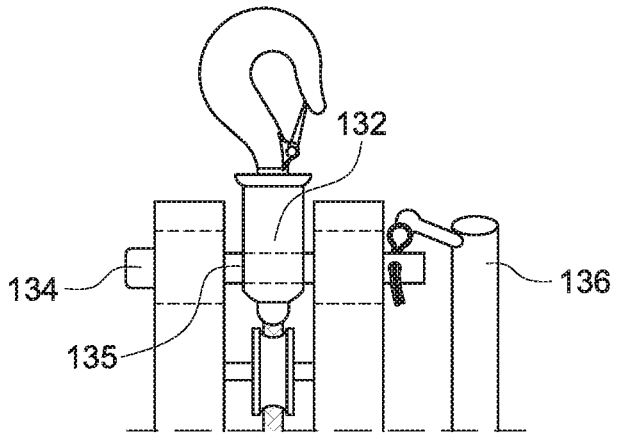
FIG. 10 is a sectional view of the portable hoist and winch guide arm in FIG. 9 with the safety pin attached.

FIGS. 9 and 10 illustrate an alternate embodiment of the portable hoist. In this embodiment, the safety pin 134 is configured to engage and activate a limit switch 136. The safety pin 134 inserts through the pin openings 132 and activates the limit switch 136. The limit switch 136 is configured to power off the winch and switches power to the hoist. When the limit switch 136 is deactivated, the winch motor is powered.

What is further disclosed is a method of operating a portable hoist. Preferably, in operating the portable hoist, the winch cable should be unwound. The winch hook attaches to a desired attachment point, such as over an object desired to be hoisted from the ground. After the winch hook is attached to the attachment point, the winch is activated and pulls the portable hoist toward the attachment point. Once the cable is appropriately wound up, the pin opening of the winch shackle aligns with the pin openings of the cable guide. The winch preferably does not wind up the cable further than the alignment point between the pin openings. Once in position, a safety pin, such as a clevis pin or hitch pin, is inserted through the pin openings to safely secure the portable hoist into a desired position over the object to be hoisted. Once the safety pin is inserted into the pin openings, the user can activate the hoist to hoist an object.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

I claim:

1. A portable hoist comprising:

a hoist, said hoist comprising a drum and a hoisting cable, wherein said hoist is configured to lift or lower an object using said hoisting cable;

a winch, said winch being attached to said hoist and wherein said winch comprises a motor and a winch cable, wherein said winch cable is configured to attach to an elevated attachment point;

wherein said winch is configured to raise said hoist proximate to said elevated attachment point or lower said hoist from said elevated attachment point, wherein said winch is configured for securing said hoist proximate to said elevated attachment point such that said hoist can lift or lower said object; wherein said hoist comprises a housing configured to house said drum and said hoist cable, said housing further comprising a cable guide, said cable guide comprising a first side and a second side defining a cable passageway configured for said cable to extend through;

wherein said first side and said second side define pin openings configured for insertion of a safety pin, wherein winch cable further comprises a hook assembly attached to the distal end of said winch cable, said hook assembly defines a hook pin opening configured for said safety pin, wherein said safety pin is configured to secure said hook assembly to said cable guide.

2. The portable hoist of claim 1 wherein said hoist further comprises a limit switch, said limit switch being configured to alternate power between said winch and said hoist, said limit switch being configured to activate power to said hoist and deactivate power to said winch when said winch secures said hoist proximate to said elevated attachment point, said limit switch being configured to deactivate power to said hoist and activate power to said winch when winch unsecures said hoist from a position proximate to said elevated attachment point.

3. The portable hoist of claim 1 wherein said hook assembly comprises a winch hook connected to a shackle, said shackle defining said hook pin opening configured for said safety pin.

4. The portable hoist of claim 1, wherein said winch and said hoist are operated by a remote.

5. The portable hoist of claim 1, wherein said winch is operated by a first remote and said hoist is operated by a second remote.

6. The portable hoist of claim 1, wherein said cable guide further comprises a pulley configured to reduce the force exerted on said winch motor.

7. A portable hoist comprising:

a hoist, said hoist comprising a drum, a hoisting cable and a hoist housing, wherein said hoist is configured to lift or lower an object;

a winch, said winch being attached to said hoist housing, wherein said winch further comprises a motor, a cable, and a hook assembly, wherein said hook assembly is configured to attach to an elevated attachment point and said winch is configured to lift said hoist proximate to said elevated attachment point;

wherein said housing further comprising a cable guide, said cable guide comprising a first side and a second side defining a cable passageway configured for said cable to extend through;

a safety pin, said safety pin being configured to secure said hook assembly to said cable guide such that said hoist is secured proximate to said elevated attachment point.

8. The portable hoist of claim 7, wherein said hoist further comprises a limit switch, said limit switch being configured to alternate power between said winch and said hoist, said limit switch being configured to activate power to said hoist and deactivate power to said winch when said safety pin is inserted into said cable guide, said limit switch being configured to deactivate power to said hoist and activate power to said winch when said safety pin is removed from said cable guide.

9. The portable hoist of claim 7, wherein said cable guide further comprises a pulley configured to reduce the force exerted on said winch motor.

10. The portable hoist of claim 7, wherein said winch and said hoist are operated by a remote.

11. The portable hoist of claim 7, wherein said winch is operated by a first remote and said hoist is operated by a second remote.

12. The portable hoist of claim 7 wherein said hoist is pneumatic.

13. The portable hoist of claim 7 wherein said hoist is electric.

14. A method of using a portable hoist, said method comprising the following steps:

the step of providing a portable hoist, wherein said portable hoist comprises a hoist, said hoist comprising a housing, said housing further comprising a cable guide, said cable guide comprising a first side and a second side, a winch, said winch being attached to said hoist housing, wherein said winch further comprises, a motor, a cable, wherein said cable extends from said winch and through said cable guide, a hook assembly, said winch being configured to lift said hoist, wherein said winch hook assembly is configured to attach to an elevated attachment point, said winch being configured to pull said hoist to said elevated attachment point, a safety pin, said safety pin being configured for insertion into said cable guide and said hook assembly, wherein said safety pin secures said hook assembly to said cable guide and a limit switch, said limit switch being configured to alternate power between said winch and said hoist, said limit switch activating power to said hoist when said safety pin is inserted through said passageway opening and said shackle opening;

the step of attaching unwinding said cable of said winch and attaching said winch hook to said elevated attachment point;

the step of winding up said cable of said winch, pulling said portable hoist to said elevated attachment point until said passageway opening aligns with said shackle opening;

the step of inserting said safety pin through said cable guide and said hook assembly, securing said portable hoist to said elevated attachment point and activating said limit switch;

the step of hoisting an object using said hoist.

* * * * *